US005675470A

United States Patent [19]

Gong

[11] Patent Number: 5,675,470

[45] Date of Patent: Oct. 7, 1997

[54] USING SPUTTER COATED GLASS TO STABILIZE MICROSTRIP GAS CHAMBERS

[75] Inventor: Wen G. Gong, Albany, Calif.

[73] Assignee: The Regents of the University of California, Oakland, Calif.

[21] Appl. No.: 499,698

[22] Filed: Jul. 7, 1995

[51] Int. Cl.[6] ..... H05F 3/02

[52] U.S. Cl. ..... 361/220; 361/212

[58] Field of Search ..... 361/212, 220

[56] References Cited

U.S. PATENT DOCUMENTS 5,500,534 3/1996 Robinson et al. ..... 250/385.1

OTHER PUBLICATIONS

A.Oed, et al., "Position–Sensitive Detector with Microstrip Anode for Electron Multiplication with Gases", Nucl. Instr. and Meth. vol. A263 pp. 351–359 (1988).

F.Angelini, et al., "A Microstrip Gas Avalanche Chamber wotj Two–Dimensional Readout", Nucl. Instr. and Meth., vol. A283 pp. 755–761 (1989).

A.Oed, et al, "A New Position Sensitive Proportional Counter with Microstrip Anode for Neutron Detection", Nucl. Instr. and Meth., vol. A284 pp. 223–226 (1989).

F.Hartjes, et al, "A Prototype Microstrip Gas Detector", Nucl. Instr. and Meth. vol. A289 pp. 384–387 (1990).

F.Angelini, et al, "The Microstrip Gas Chamber", Nucl. Phys. vol. 23A, pp. 254–260 (1991).

F.Angelini, et al, "Results from the First use of Microstrip Gas Chambers in a High–Energy Physics Experiment", Nucl. Instr. and Meth. vol. A315, pp. 21–32 (1992).

Budtz–Jorgensen, et al, "Microstrip Proportional Counters for Xray Astronomy", Nucl. Instr. and Meth. vol. A310, pp. 82–87 (1991).

M.Salomon,et al, "Some Properties of Gas Microstrip Detectors Made on Tedlar Substrates and Operating With $CF_4$/Isobutane Gas",IEEE 1993 Nuclear Science Symposium, San Francisco, Nov. 2–6, 1993.

R.Bouclier, et al, "Development of Microstrip Gas Chambers on Substrata with Electronic Conductivity", IEEE 1993 Nuclear Science Symposium, San Francisco, Nov. 2–6, 1993.

S.Brons, et al,"Use of Ultra Thin Semiconductive Layers as Passivation in Microstrip Gas Chambers", Nucl. Instr. and Meth. vol. A342, pp. 411–415 (1994).

W.G.Gong, et al., "Microstrip Gas Chambers on Glass and Ceramic Substrates" IEEE Transactions on Nuclear Science, vol. 41 No. 4 (1994).

C.Budtz–Jorgensen, "Features of the Microstrip Proportional Counter Technology (Invited)", Rev. Sci. Instrum. vol. 63, pp. 648–659 (1992).

R. Bouclier, et al, "High Flux Operation of Microstrip Gas Chambers on Glass and Plastic Supports", Nucl. Instr. and Meth. vol. A323, pp. 240–246 (1992).

R. Bouclier, et al., "Performance of Gas Microstrip Chambers on Glass Substrata with Electronic Conductivity", Nucl. Instr. and Meth. vol. A332 pp. 100–106 (1993).

G.D. Minakov, et al., "Performance of Gas Microstrip Chambers on Glass with Ionic and Electronic Conductivity" Nucl. Instr. and Meth. vol. A326 pp. 566–569 (1993).

Yu.N. Pestov, et al., "Influence of the Bulk Resistivity of Glass with Electronic Conductivity on the Performance of Microstrip Gas Chamber", Nucl. Instr. and Meth., vol. A338 pp. 368–374 (1994).

*Primary Examiner*—Fritz Fleming

*Attorney, Agent, or Firm*—Paul Martin; Janis Biksa

[57] ABSTRACT

By sputter coating a thin-layer of low-resistive, electronically-conductive glass on various substrates (including quartz and ceramics, thin-film Pestov glass), microstrip gas chambers (MSGC) of high gain stability, low leakage current, and a high rate capability can be fabricated. This design can make the choice of substrate less important, save the cost of ion-implantation, and use less glass material.

11 Claims, 2 Drawing Sheets

USING SPUTTER COATED GLASS TO STABILIZE MICROSTRIP GAS CHAMBERS

FIELD OF THE INVENTION

This invention relates to microstrip gas chambers used to detect the presence of radiation such as x-rays and charged atomic particles and a configuration and method used to improve their reliability.

BACKGROUND OF THE INVENTION

A microstrip gas chamber is a way of detecting electrons in a gas which detect X-rays or charged particles (protons, alpha particles, beta particles, high energy electrons, high energy heavy ions) are tracked, for example nuclear physics experiments, at atmospheric pressure, or in some instances at elevated pressures. A high electric field region where as the electrons drift in to the gas chamber (Xenon, mixture of Argon-methane, mixture of Helium-ethane, mixture of noble gas with an organic gas that helps stabilize the performance, a di-methyl ether) they avalanche (a high enough field is present that when they collide with charged gas molecules to release more electrons to get an amplification process for signal detection—start from one collision to arrive at a regularly achieved amplification of such one collision). The problem with the microstrip gas chamber is that the gain (the multiplication of the signal) varies. The field of microfabrication of gas detectors has progressed rapidly since Oed introduced the Microstrip Gas Chamber (MSGC). Because of its good spatial resolution (about 30 μm for minimum ionizing particles), excellent energy resolution (11% for $^{55}$Fe x-rays), and high rate capability (over $10^6$ Hz/mm$^2$), the MSGC has found many applications such as charged-particle tracking and x-ray imaging.

Gain instability has been a continuing source of errors in detection and the unreliability of detection readings. Gain instability has been the subject of extensive research. The accumulation of positive ions on the insulator (substrate) surface between anode and cathode is known to be responsible for gain instability in a MSGC. Further, the time scale of ion recombination on the surface will determine the rate capability of a MSGC. Systematic studies have shown that the higher surface conductivity, the higher rate capability. To achieve a stable MSGC a surface layer with large electronic conductivity is essential.

Two approaches already exist for controlling gas gain stability effectively. One is to modify the surface conductivity by ion-implantation, the other is to choose an electronically-conducting substrate.

To have high surface conductivity, one can ion-implant the insulator surface or use low-resistive, electronically-conducting substrate directly.

A typical dosage of B-ion implantation on $SiO_2$ film is $4\times10^{16}$ ions/cm$^2$ in order to make the MSGC stable. This dosage is rather high and may be difficult to achieve for a large-scale application.

The use of low-resistive, electronically-conducting substrate like a special Pestov glass is straightforward. However, a large supply of such a special glass is not typically available. Such a glass has a rather large leakage current which is not desirable either.

SUMMARY OF THE INVENTION

A configuration according to the invention provides an insulative substrate including a surface subject to charge build up, a thin layer of an electronically conductive glass containing iron in the form of iron oxide coating the surface subject to charge buildup, and a set of alternating cathode and anode conductors on the surface, wherein the thin layer provides a bleed path for continuous dissipation of electrical charge acquired by the surface, generally without distorting the electrical signals being measured by the cathode and anode conductors. The conductive glass has a resistivity of less than $10^{12}$ ohm * cm. The conductive glass can be a Pestov glass.

The thin layer of an electronically conductive glass can be sputter deposited on the surface subject to charge buildup to provide a uniform coating thickness and charge rate dissipation across the surface;

The electronically conductive glass can contain iron in the form of iron oxide to provide a resistivity of less than $10^{12}$ohm * cm, for example a Pestov glass, (the actual formulation of Pestov glass is understood to be a secret and therefore cannot be more precisely described).

According to the invention a method of nearly eliminating the charge build-up on the surface of a substrate exposed to a charge source comprises the steps of: placing a substrate in a sputtering chamber; sputter depositing a thin layer of electronically conductive glass on the surface of the substrate; and fabricating a set of anode and cathode conductors on the surface of the thin layer of electronically conductive glass, wherein the electronically conductive glass contains iron in the form of iron oxide. For example where the electronically conductive glass is a Pestov glass having a resistivity of less than $10^{12}$ohm * cm.

DETAILED DESCRIPTION

Besides using ion-implantation and electronically-conductive glass to improve surface conductivity, an alternative solution involves using the technique of thin-film coating for MSGCs to minimize or eliminate the charging-up problem independent of the support material.

For example, very thin layers (2–20 nm) of semiconductive germanium had been evaporated onto glass and plastic substrates. Stable gains had been observed for rates up to $10^5$ mip/s/mm$^2$. However, it was not dear if oxidation of Ge would affect the performance and how to maintain uniformity of the thin film over a large area.

In another example, thin layers of nickel or chromium oxide had been applied to MSGCs on a plastic support. Stable gain was obtained over a period of 30 days.

In still another example, layers of 30–100 nm thick lead glass have also been coated onto MSGCs on Desag glass which showed that a lead glass coating could improve time-dependent stability and rate capability.

Figure 1:
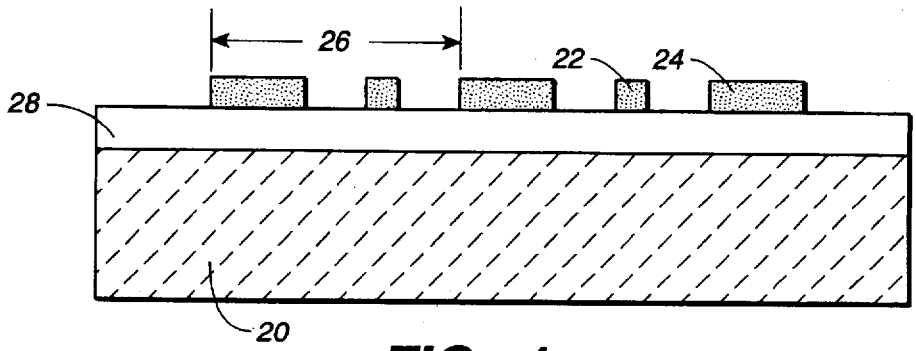
FIG. 1, shows the structure of a MSGC on thin-film Pestov glass according to the invention.

A configuration and method according to the invention as shown in FIG. 1 includes providing a MSGC on thin-film electronically (in an electronic glass the carders of the charge are electrons as opposed to positive ions and conductivity is maintained without aging effects) conductive (Pestov) glass as a thin film over a substrate. A stable MSGC is constructed by sputter-coating a layer of the electronically conductive (Pestov) glass on a substrate first and then defining the anode-cathode structure thereon.

The structure which is constructed by sputtering Pestov glass will have favorable bleed off characteristics. Effectively providing a rate dependent $<10^{12}$ohm * cm surface resistivity, although the specific parameters constructed and tested are described below.

The Pestov glass is sputter coated on a substrate before making the microstrips. It has been demonstrated that low-resistive Pestov glass ($\rho=10^9-10^{12}$ Ω * cm) is an effective substrate material for making MSGCs. One advantage of coating Pestov glass is to reduce the leakage current significantly. Because of this, it is possible to use a Pestov glass of ρ less than $10^9$ Ω * cm and to push the rate capability up to the space-charge limit. Furthermore, the glass coating seems to be less sensitive to oxidation than a Ge/Ni/Cr coating and the process of sputtering is easier to control than a chemical vapor deposition which is dependent on flow regimes of gasses and temperature uniformity. The type of Pestov glass used was model S8900 supplied by Schott Glass Technologies (USA). Its bulk resistivity is $1.4\times10^{11}$ Ω * cm.

It has a chemical ingredients (according to the supplier) of:

| | |
|---|---|
| Silica | 20–50% |
| Barium Oxide | 20–50% |
| Sodium Oxide | 1–10% |
| Iron Oxide | 10–20% |
| Strontium Oxide | 1–10% |
| Vanadium Oxide | 1–10% |
| Melting Point | 736° C. |
| Solid Density | 3.42 g/cm$^3$ |
| Bulk resistivity | $1.4\times10^{11}$ Ω * cm. |

The material is brittle and difficult to bond to a sputter target backing plate, although it was successfully bonded using an epoxy (High Vacuum Torr Seal™) that is good for vacuum in that it has low off gassing characteristics. Sputtering was done with an Argon plasma at a 6 millitorr pressure with a 1700 VDC bias.

Over-coating can passivate the electrodes and prevent from polymer deposition, but it will modify the gain response somehow and require extra protection of bonding traces during coating. Meanwhile, under-coating will not affect the gain response and make the microstrip processing independent.

A microstrip gas chamber was first constructed on bulk S8900 glass, and tested in an Ar—$CH_4$ gas mixture using a 100 μCi $^{55}$Fe source. An energy resolution (FWHM—Full Width at Half Maximum) of 15% was achieved for 6 keV x-rays. At a rate of $5\times10^4$ photons/sec/mm$^2$, the gas gain was stable within 3% for 2 hours. A gain of 1000 was obtained at 530 V. The behavior of leakage current vs. bias voltage was found to be ohmic, indicative of electronic conduction. Energy spectra of $^{55}$Fe x-rays and gain dependencies on anode and cathode voltages confirm chamber stability.

FIG. 1 shows the structure of a MSGC on thin-film Pestov glass. It started with a pre-polished quartz wafer, ceramic plate, or Si wafer with insulator as mechanical support 20. Once cleaned, the substrate was loaded into the sputtering chamber. The target was a 5 inch disk of S8900 glass under water cooling. The sputtering process occurred in a low-pressure (6 mTorr) Ar plasma. The glass deposition rate was about 60 Å/min at 200 W RF power and at 300 sccm Ar flow. The thickness of S8900 glass thin film was typically 0.5–1.0 μm. After the coating, Al microstrips were fabricated on top of the S8900 glass layer 28. The widths of the anode 22 and cathode 24 strips were 10 μm and 90 μm, respectively. The anode-to-anode pitch 26 was 200 μm. The measured leakage currents were less than 1 nA at 500V bias and varied linearly as a function of the bias voltage.

Figure 2:
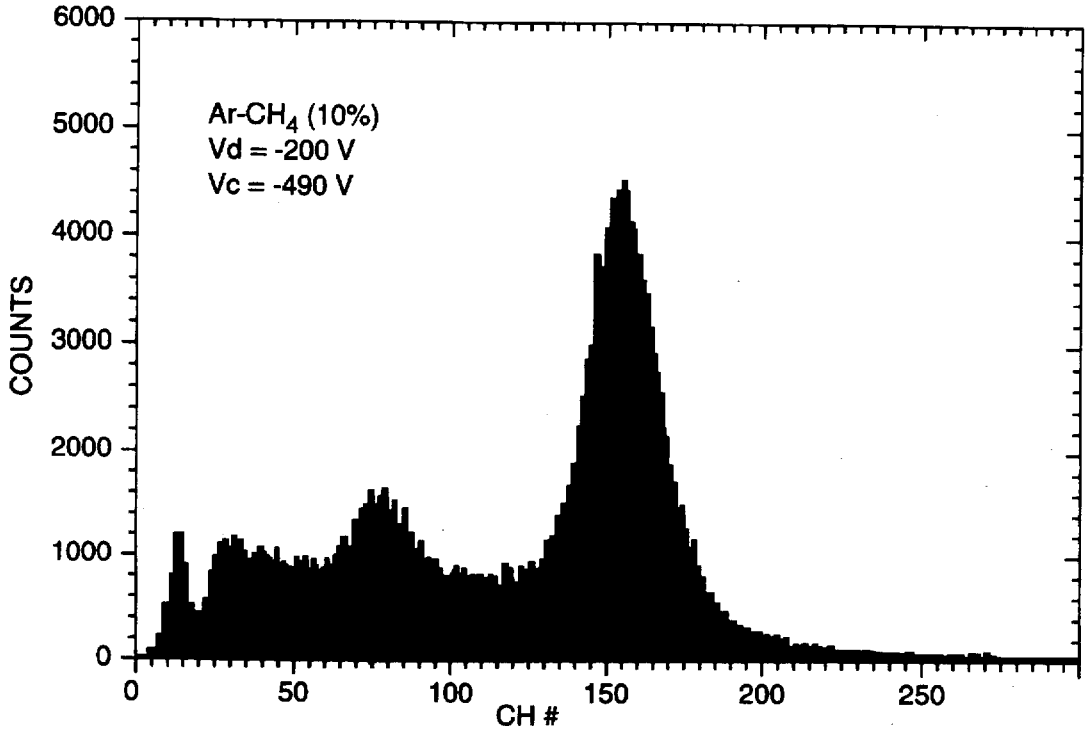
FIG. 2 shows $^{55}$Fe x-ray spectra measured by a MSGC on thin-film Pestov glass according to the invention on an alumina substrate in the Ar—$CH_4$(10%) gas mixture.

FIG. 2 shows the $^{55}$Fe x-ray spectrum measured by a MSGC on thin-film Pestov glass on an alumina substrate in the Ar—$CH_4$(10%) gas mixture. The drift voltage was −200 V and the cathode voltage was −490 V, while the anode voltage was at ground. This spectrum was taken with the $^{55}$Fe source on for three hours at a rate of 50000 photons/sec/mm$^2$. Both the photo-peak and the escape peak are well resolved. The energy resolution (FWHM) was 17% at 6 keV. The gain variation was less than 5% for over 3 hours. The flat background aside from the photo-peak and escape peak was due to incomplete charge collection since only four anode strips were connected together.

Figure 3:
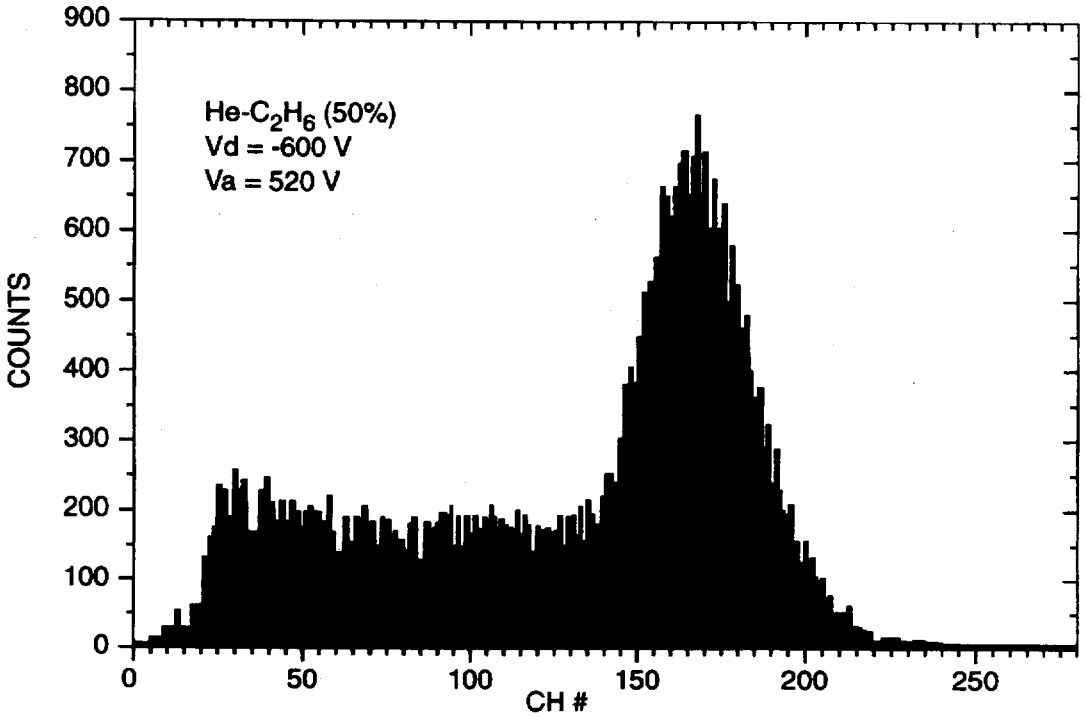
FIG. 3 shows $^{55}$Fe x-ray spectra measured by a MSGC on thin-film Pestov glass according to the invention on a quartz substrate in the He—$C_2H_6$(50%) gas mixture.

FIG. 3 shows the $^{55}$Fe x-ray spectrum measured by a MSGC on thin-film Pestov glass on a quartz wafer in the He—$C_2H_6$(50%) gas mixture. The drift voltage was −600 V and the anode voltage was 520 V, while the cathode was grounded. Only a photo-peak is present. The energy resolution (FWHM) is 20% at 6 keV. The slightly worse resolution was due to the fewer electron-ion pairs in a He gas mixture. It is known that the average ionization potential for He is 41 eV and that for Ar is 26 eV.

Figure 4:
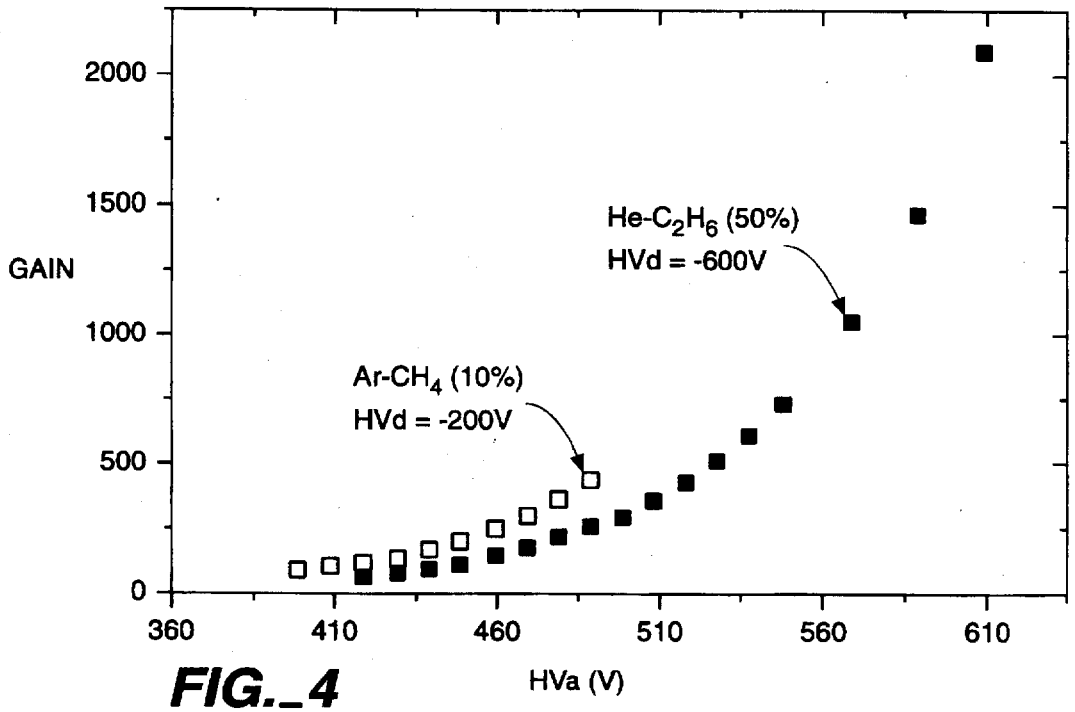
FIG. 4 shows gas gain dependence on the anode voltage for a MSGC on thin-film Pestov glass according to the invention on a quartz substrate in two different gas mixtures.

The gas gain dependence measured on anode voltage for a MSGC on thin-film S8900 glass on a quartz substrate is shown in FIG. 4. As expected, higher maximum gain can be obtained with a greater fraction of quenching gas. The maximum gain for the He—$C_2H_6$(50%) gas mixture is about twice that for the Ar—$CH_4$(10%) gas mixture. A MSGC built on thin-film S8900 glass on alumina substrate behaved similarly.

In summary, by coating a thin-layer of low-resistive, electronically-conductive glass on various substrates (including quartz and ceramics). MSGCs of high gain stability and low leakage current were constructed and tested in Ar—$CH_4$(10%) and He—$C_2H_6$(50%) gas mixtures. Energy resolutions of 17–20% were measured for 6 keV x-rays. A design according to the invention can make the choice of substrate less important, save the cost of ion-implantation, and use less glass material.

The construction of the structure as described involves the use of a novel method of constructing MSGC, namely by sputter coating a thin layer of glass onto a substrate and then applying the anode and cathode conductors. This same techniques could be used in other applications where one wants to prevent electrostatic charge build-up on an insulator.

While the invention has been described with regards to specific embodiments, those skilled in the art will recognize that changes can be made in form and detail without departing from the spirit and scope of the invention.

I claim:

1. An apparatus configuration comprising:

an insulative substrate including a surface subject to charge build up, a thin layer of an electronically conductive glass containing iron in the form of iron oxide coating said surface subject to charge buildup, a set of alternating cathode and anode conductors on said surface, wherein said thin layer provides a bleed path for continuous dissipation of electrical charge acquired by the surface, substantially without distorting the electrical signals being measured by the cathode and anode conductors.

2. An apparatus configuration as in claim 1, wherein said conductive glass has a resistivity of less than $10^{12}$ohm * cm.

3. An apparatus configuration as in claim 2, wherein said conductive glass is a Schott S8900 glass.

4. An apparatus configuration comprising:

an insulative substrate including a surface subject to charge build up, a thin layer of an electronically conductive glass which has been sputter deposited on said surface subject to charge buildup, a set of alternating cathode and anode conductors on said surface, wherein said thin layer provides a bleed path for continuous dissipation of electrical charge acquired by the surface, substantially without distorting the electrical signals being measured by the cathode and anode conductors.

5. An apparatus configuration as in claim 4;

wherein said electronically conductive glass contains iron in the form of iron oxide.

6. An apparatus configuration as in claim 5, wherein said conductive glass is a Schott S8900 glass.

7. An apparatus configuration as in claim 4, wherein said conductive glass has a resistivity of less than $10^{12}$ohm * cm.

8. A method of nearly eliminating the charge build-up on the surface of a substrate exposed to a charge source comprising the steps of:

placing a substrate in a sputtering chamber:

sputter depositing a thin layer of electronically conductive glass on the surface of the substrate;

fabricating a set of anode and cathode conductors on the surface of the thin layer of electronically conductive glass; and providing a bleed path for continuous dissipation of electrical charge acquired by the surface through said thin layer of electronically conductive glass, substantially without distorting the electrical signals being measured by the cathode and anode conductors.

9. A method of nearly eliminating the charge build-up on the surface of a substrate exposed to a charge source as in claim 8, wherein said electronically conductive glass contains iron in the form of iron oxide.

10. A method of nearly eliminating the charge build-up on the surface of a substrate exposed to a charge source as in claim 9, wherein said electronically conductive glass is a Schott S8900 glass.

11. A method of nearly eliminating the charge build-up on the surface of a substrate exposed to a charge source as in claim 8, wherein said electronically conductive glass has a resistivity of less than $10^{12}$ohm * cm.

* * * * *